US006692418B2

(12) United States Patent
Shahan

(10) Patent No.: US 6,692,418 B2
(45) Date of Patent: Feb. 17, 2004

(54) BACK STRENGTHENING APPARATUS

(75) Inventor: Emory L. Shahan, Mesa, AZ (US)

(73) Assignee: BackHealth USA, Queen Creek, AR (US)

( * ) Notice: Subject to any disclaimer, the term of this patent is extended or adjusted under 35 U.S.C. 154(b) by 0 days.

(21) Appl. No.: 09/991,008

(22) Filed: Nov. 16, 2001

(65) Prior Publication Data

US 2002/0142899 A1 Oct. 3, 2002

Related U.S. Application Data

(60) Provisional application No. 60/249,799, filed on Nov. 18, 2000.

(51) Int. Cl.[7] ..... A63B 26/00

(52) U.S. Cl. ..... 482/144; 143/148; 143/907; 143/145

(58) Field of Search ..... 482/144, 143, 482/148, 145, 907, 908

(56) References Cited

U.S. PATENT DOCUMENTS

| | | | | | |
|---|---|---|---|---|---|
| 3,567,218 | A | | 3/1971 | Johnson | |
| 3,682,475 | A | * | 8/1972 | Walker | 272/58 |
| 4,266,766 | A | * | 5/1981 | Calderone | 272/117 |
| 4,324,399 | A | | 4/1982 | Rickey | |
| 4,332,381 | A | | 6/1982 | Lyons | |
| 4,572,505 | A | * | 2/1986 | Kornhaus | 272/96 |
| 4,620,701 | A | | 11/1986 | Mojden | |
| D296,808 | S | | 7/1988 | Urbanc | |
| 4,759,539 | A | | 7/1988 | Nieppola | |
| 4,832,336 | A | | 5/1989 | Lahman | |
| 4,884,804 | A | | 12/1989 | Fenwick | |
| 4,913,424 | A | | 4/1990 | Pepin | |
| 4,927,135 | A | | 5/1990 | Nieppola | |
| 4,976,428 | A | | 12/1990 | Ghazi | |
| 5,176,603 | A | | 1/1993 | Hundley et al. | |
| 5,183,452 | A | * | 2/1993 | Bacon et al. | 482/97 |
| 5,190,513 | A | | 3/1993 | Habing et al. | |
| 5,582,565 | A | * | 12/1996 | Soria | 482/141 |
| 5,935,050 | A | * | 8/1999 | Shahan | 482/142 |

* cited by examiner

*Primary Examiner*—Nicholas D. Lucchesi
*Assistant Examiner*—L Amerson
(74) *Attorney, Agent, or Firm*—Snell & Wilmer, L.L.P.

(57) ABSTRACT

A back strengthening apparatus having first and second horizontal base members attached perpendicularly to one another, a support member for supporting a user's lower trunk area and means for securing the support member in vertical position above the horizontal base members, and a planar support plate adjoining the securing means. The support member includes at least one indentation for positioning and supporting a user's lower trunk area during exercise.

11 Claims, 9 Drawing Sheets

BACK STRENGTHENING APPARATUS

CROSS-REFERENCE TO RELATED APPLICATIONS

This application claims the benefit of U.S. Provisional Application Ser. No. 60/249,799, filed Nov. 18, 2000.

FIELD OF INVENTION

The present invention generally relates to an apparatus for exercising the human body and enhancing the body's overall health, particularly an individual's back health. More particularly, the present invention relates to an apparatus specifically designed to perform a number of back strengthening exercises which exercise an individual's back muscles and enhance the overall health of an individual's back.

BACKGROUND OF THE INVENTION

The present invention relates generally to an apparatus and method which aid in exercising the human body and enhancing the body's overall health. More particularly, the present invention relates to an apparatus specifically designed for performing reverse sit-ups and other exercises and a method for strengthening an individual's back muscles and enhancing the overall health of an individual's back.

Epidemiological studies have indicate that back pain afflicts approximately 60to 80% of the population in the Western world. An estimated 75 million Americans currently suffer from back pain. In addition, over 16 million Americans visit their doctors each year because of back pain. This number does not include visits to chiropractors and other therapists who treat back pain.

Furthermore, the number of Americans in bed due to back pain on any single day is estimated at 6 million and an estimated 93 million workdays are lost every year in the United States due to back pain. The costs associated with back pain relating to diagnosis and treatment, loss of productivity, disability payments, Worker's Compensation, and lawsuits are high. The U.S. federal government estimates that approximately 14 billion dollars is spent on back pain each year.

Back pain can result from a number o problem areas in the back. Many problem areas are attributed, to the degenerative process of the spine which begins after the bones of the spinal column have reached their mature size. This usually occurs when an individual reaches their mid-twenties. However, although the degeneration of the spine can result in back pain, a great deal of back pain has been shown to be related o an individual's inactivity.

Spinal ligaments, the tough bands of connective tissue that bind the vertebrae of the spine together, frequently begin to lose some of their strength as a result of inactivity and aging. When these ligaments become lax, thereby losing some of their ability to support the spine, it is very important to have strong muscles to compensate for their lack of spinal support. Unlike ligaments, muscles are extremely elastic and can therefore help maintain the proper posture of the back. However, when the muscles associated with the spine become weakened from chronic strain and inactivity, they cannot perform their job in aiding the support of the back.

Therefore, in that today's lifestyles seldom include back strengthening activities, there is a need for a simple apparatus and method for strengthening the back muscles in order to enhance the overall health of the back and thereby reduce or eliminate back pain.

SUMMARY OF THE INVENTION

The present invention comprises a simple apparatus for strengthening the muscles in an individual's back. Briefly, the apparatus includes a base structure having a first horizontal base member and a second horizontal base member attached perpendicularly to the first horizontal base member, a support member for supporting a user's lower trunk area positioned above the first horizontal base member, means for securing the support member in a vertical position above the first horizontal base member, such as a bar member or pole, and a planar support plate attached to the bottom of the first horizontal base member such that the planar support member is located adjacent to the means for securing the support member but on the side of the securing means that is opposite the second horizontal base member.

The back strengthening apparatus may also include a removable foot plate that is attached to the first horizontal base member near an end opposite the second horizontal base member where the removable foot plate is adjustable along a length of the horizontal base member.

In one aspect of the invention, the support member includes at least one indentation at a position where a user's lower trunk area is supported. In one embodiment of the support member, the support member includes at least two indentations, substantially equal in shape and size to one another, that are positioned opposite one another in order to accommodate the hips of a user's trunk area. In another embodiment of the support member, the support member may include a third indentation located between the oppositely positioned indentations where the third indentation is substantially the same shape as the two oppositely positioned indentations but larger in size than the oppositely positioned indentations.

DETAILED DESCRIPTION OF THE INVENTION

Figure 1:
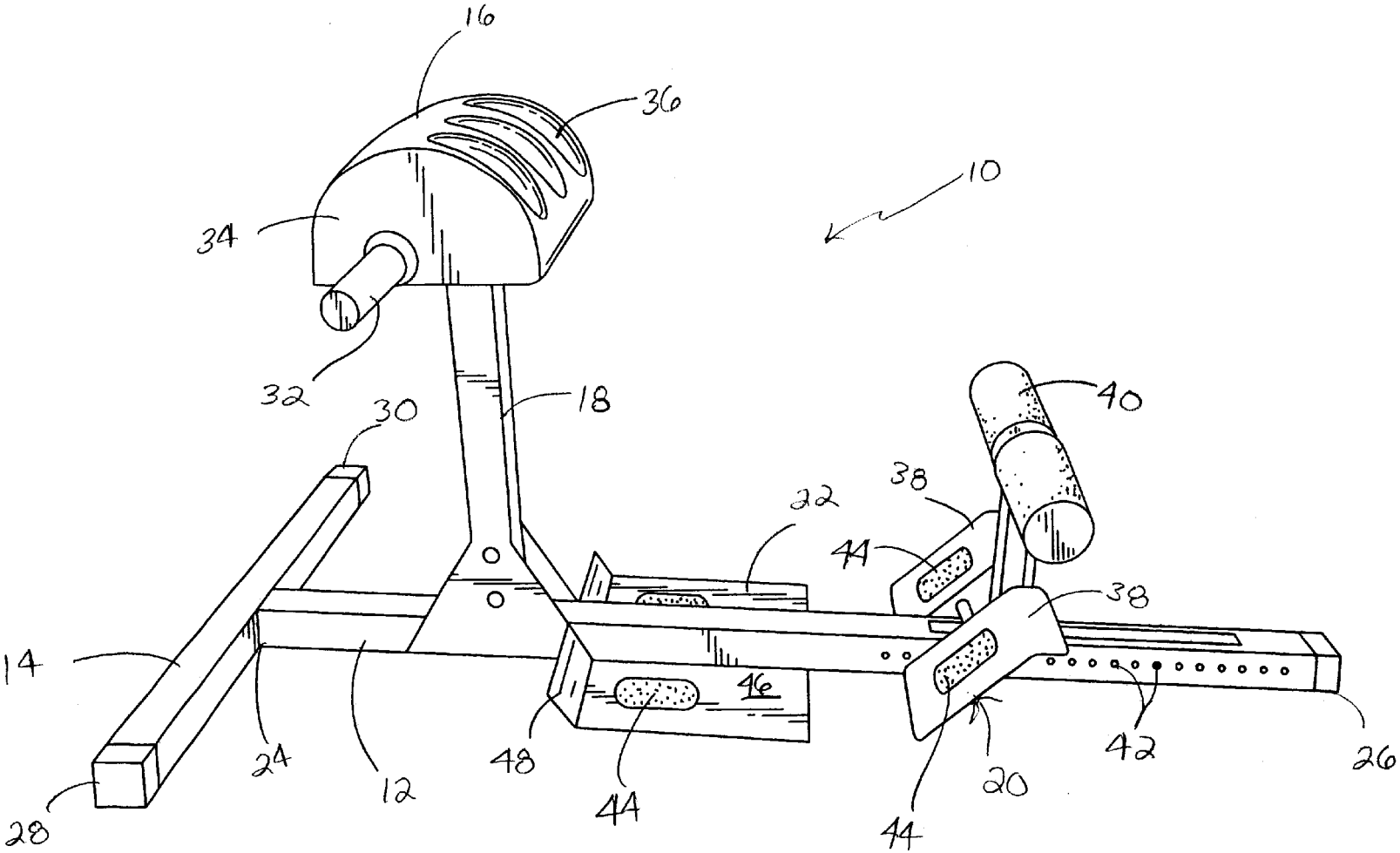
FIG. 1 is a perspective view of an exemplary embodiment of the back strengthening apparatus in accordance with the present invention.

An exemplary embodiment of the back strengthening apparatus 10 of the present invention is shown in FIG. 1. Back strengthening aparatus 10 includes a first horizontal base member 12, a second horizontal base member 14, a support member 16 for supporting a user's lower trunk area, means for securing the support member 16 in a vertical position above first horizontal base member 12 such as vertical support bar 18, a removable foot plate 20, and a planar support plate 22. First horizontal base member 12 has first and second opposite ends 24, 26 and second horizontal base member 14 has first and second opposite ends 28, 30. Second horizontal base member 14 is attached perpendicularly to first end 24 of first horizontal base member 12 at a midpoint between first and second ends 28, 30 of second horizontal base member 14.

Support member 16 is vertically positioned above first horizontal base member 12 by a securing means such as vertical support bar 18. Means for securing support member 16 in a vertical position above first horizontal base member 12 may comprise any number of shapes and/or configurations as long as the securing means an withstand the downward force of the full weight of any individual when that individual's full weight is applied to support member 16. Support member 16 preferably includes handle members 32 which extend laterally from the outermost sides 34 of support member 16. Support member 16 further preferably comprises a semi-cylindrical shape with the outer rounded surface of the half cylinder having at least one indentation 36 contained therein, and preferably three indentations for accommodating a user's pelvis and lower abdominal area.

Figure 8:
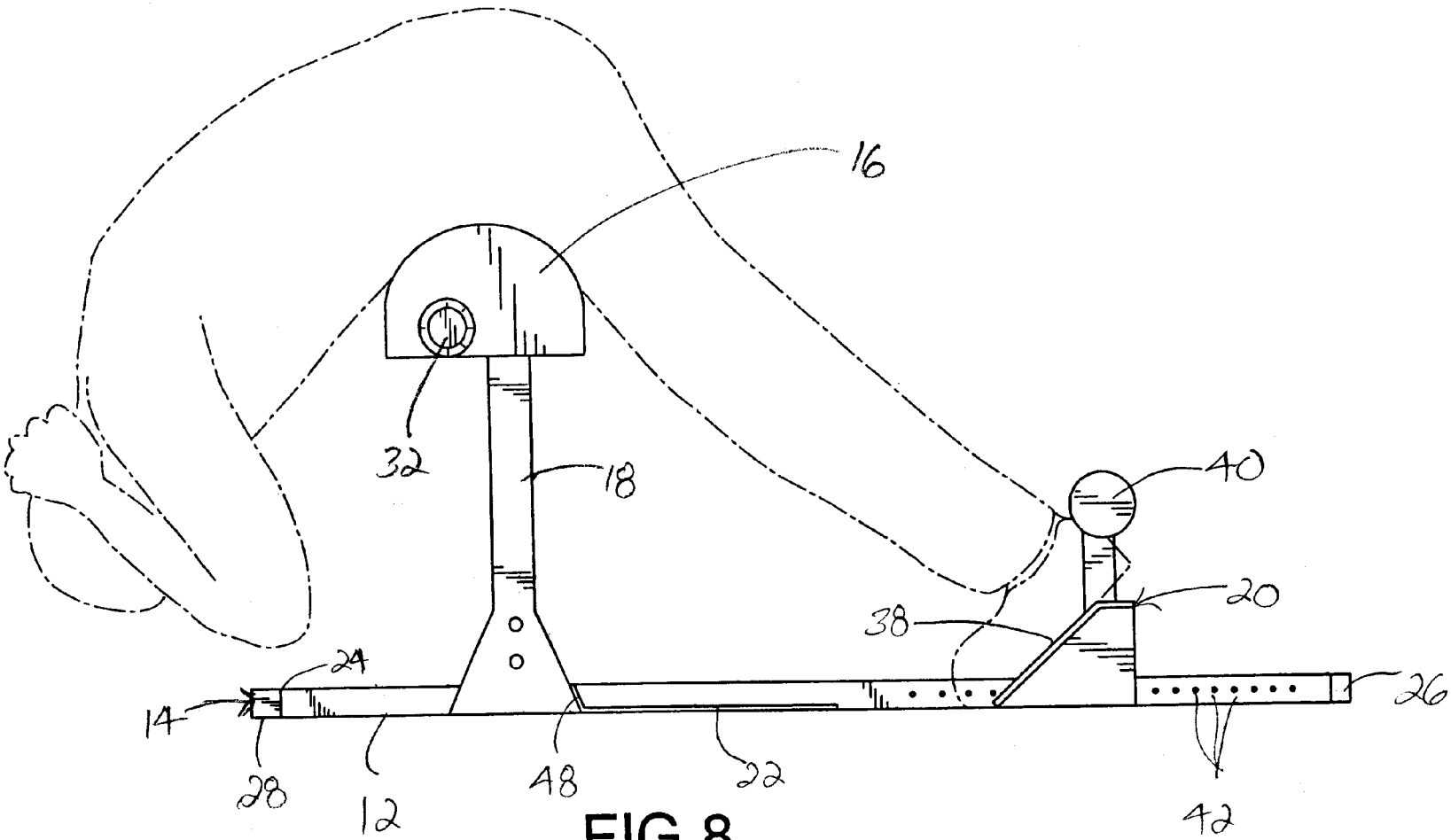
FIGS. 8–9 are side elevational views of the back strengthening apparatus of the present invention and an individual shown in phantom utilizing the apparatus to perform a back extension exercise.

As further shown in FIG. 1, foot plate 20 preferably includes a pair of planar plates 38 positioned at less than a 90 degree angle relative to the ground and a roll bar 40 connected to planar plates 38. Foot plate 20 is connected to first horizontal base member 12 so that foot plate 20 is adjustable along a length of first horizontal base member 12. This adjustable connection may be carried out by inserting a pin member through openings contained in the foot plate (not shown) and openings 42 in first horizontal base member 12 or any other means known in the art for providing adjustable connections between two elements. Planar plates 38 may further comprise at least a partial non-skid surface 44. During use of the back strengthening apparatus for particular exercises such as back extensions, a user places the bottoms of his feet on non-skid surfaces 44 of planar plates 38 and tucks he heels of his feet underneath roll bar 40 as shown in FIG. 8.

Figure 6:
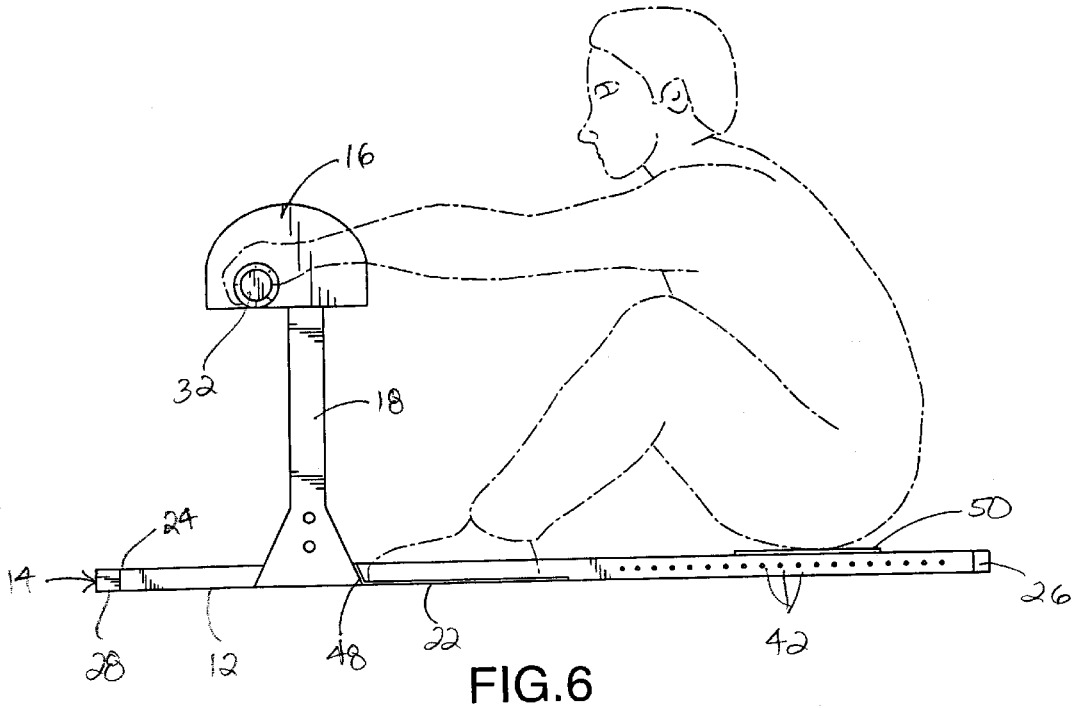
FIGS. 6–7 are side elevational views of the back strengthening apparatus of the present invention shown with the foot plate removed and an individual shown in phantom utilizing the apparatus to perform a back stretch exercise.
Figure 7:
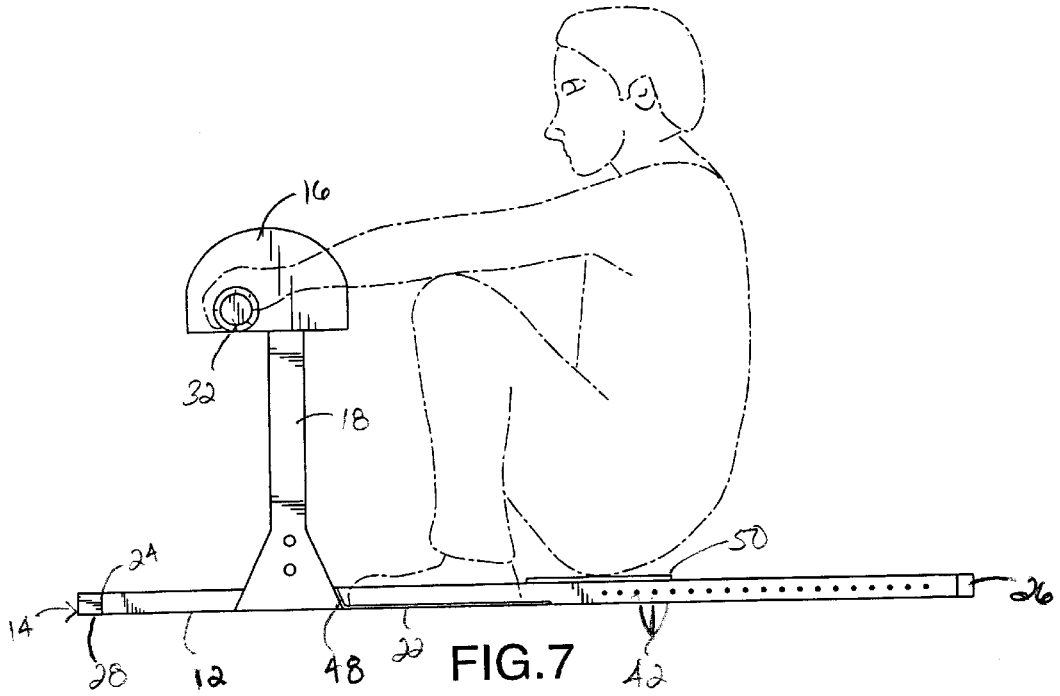

Planar support plate 22 has a top surface 46, a bottom surface (not shown), and a lip member 48 extending from upward from one of it edges at an angle preferably greater than 90 degrees relative to the ground. Top surface 46 of planar support plate 22 is secured to a bottom of first horizontal base member 12 and lip member 48 of planar support plate 22 extends from opposite sides of first horizontal base member 2. Top surface 46 of planar support plate 22 may further comprise at least a partial non-skid surface 44 like planar plates 38 of foot plate 20. During use of the back strengthening apparatus for particular exercises such as back stretches, a user straddles first horizontal base member 12 and positions his feet on non-skid surfaces 44 on top surface 46 of planar support planar 22 so that the toes of his feet touch lip member 48. The user then grabs handle members 32 on support member 16 to perform the exercise as shown in FIGS. 6–7.

Figure 2:
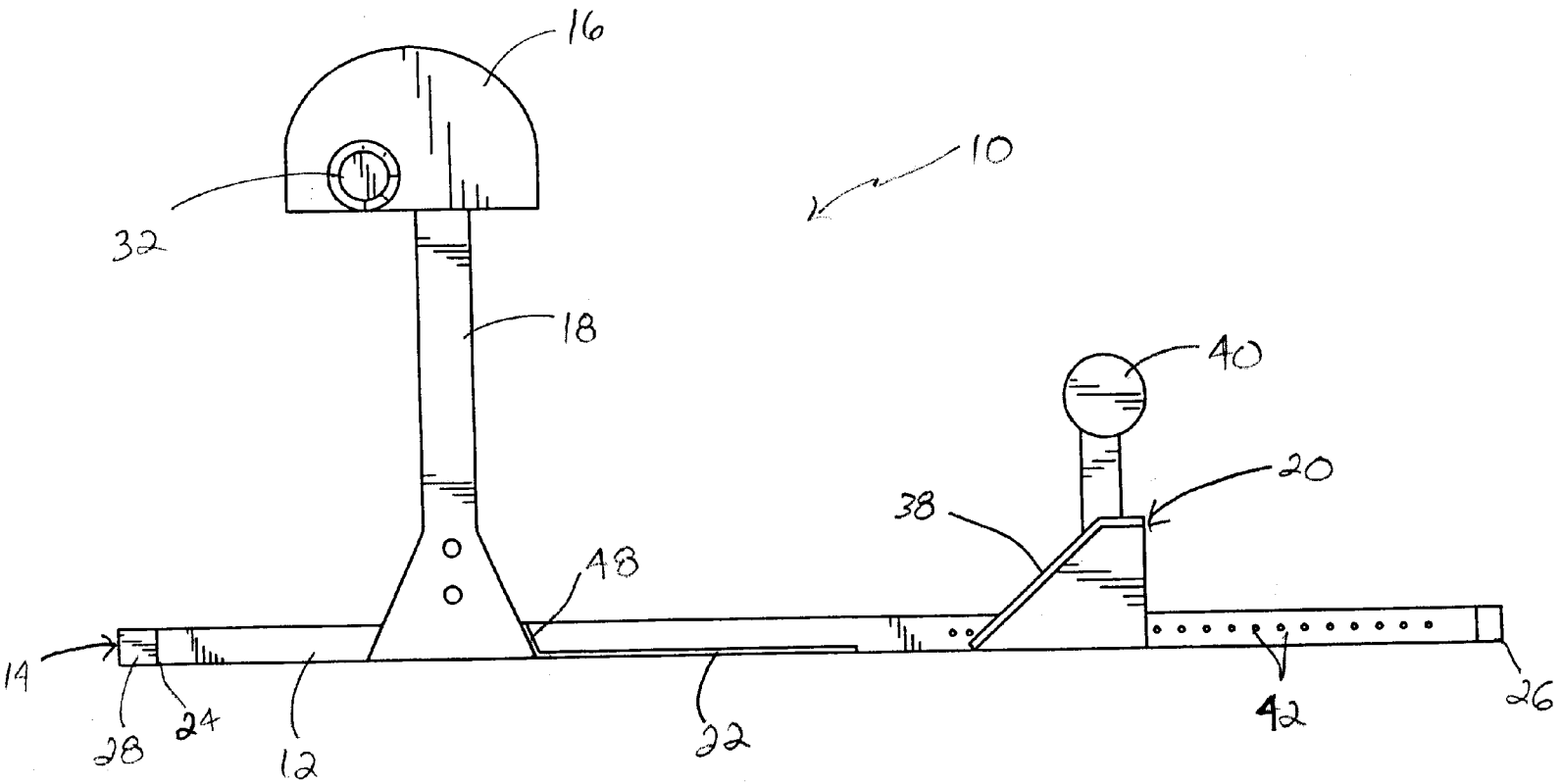
FIG. 2 is a side elevational view of the back strengthening apparatus of the present invention.

A side elevational view of back strengthening apparatus 10 is shown in FIG. 2. Vertical support bar 18 positions and secures support member 16 at a predetermined height above first horizontal base member 12. This predetermined height is calculated to accommodate all heights of various users by ensuring that support ember 16 is low enough to the ground so that a user's pelvis can be aligned adjacent to, or below, indentations 36 in support member 16 when a user stands adjacent to support member 16. when indentations 36 in support member 16 are located below a user's pelvis when the user stands adjacent to support member 16, foot plate 20 is adjusted by moving foot plate 20 along the length of first horizontal base member 12 so that it is further away from support member 16 thereby allowing a user's pelvis and lower abdominal area to lie within indentations 36 while the user's feet are placed on planar plates 38 with the user's heels tucked under roll bar 40.

For ease in disassembly and storage, the preferred embodiment of back strengthening apparatus 10 of the present invention is preferably comprised of four distinct pieces. The first piece is one continuous piece that includes first horizontal base member 12, second horizontal base member 14, and planar support plate 22. The second and third pieces are the vertical support bar 18 and support member 16, respectively which can be disconnected from one another. Vertical support bar 18 can also be disconnected from first horizontal base member 12. The fourth card final piece is foot plate 20 which can be removed from first horizontal base member 12 and includes planar plates 38 with non skid surfaces 44, roll bar 40 and means for connecting planar plates 38 to roll bar 40 and means for connecting the entire foot plate assembly to first horizontal base member 12. Handle members 32 may also be disconnected from support member 16 resulting in two additional separate pieces, namely fifth and sixth separate pieces of apparatus 10.

Figure 3:
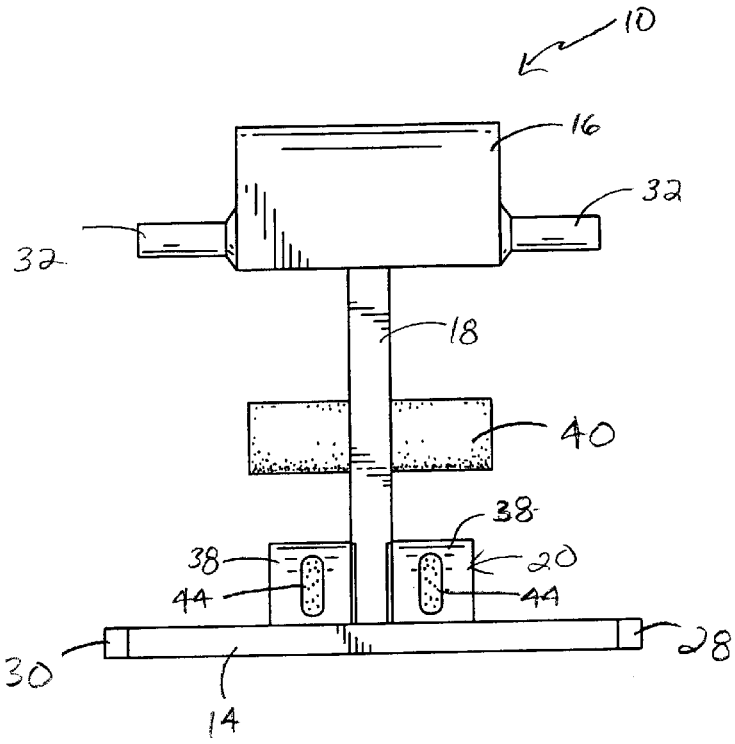
FIG. 3 is a front elevational view of the back strengthening apparatus of the present invention.
Figure 4:
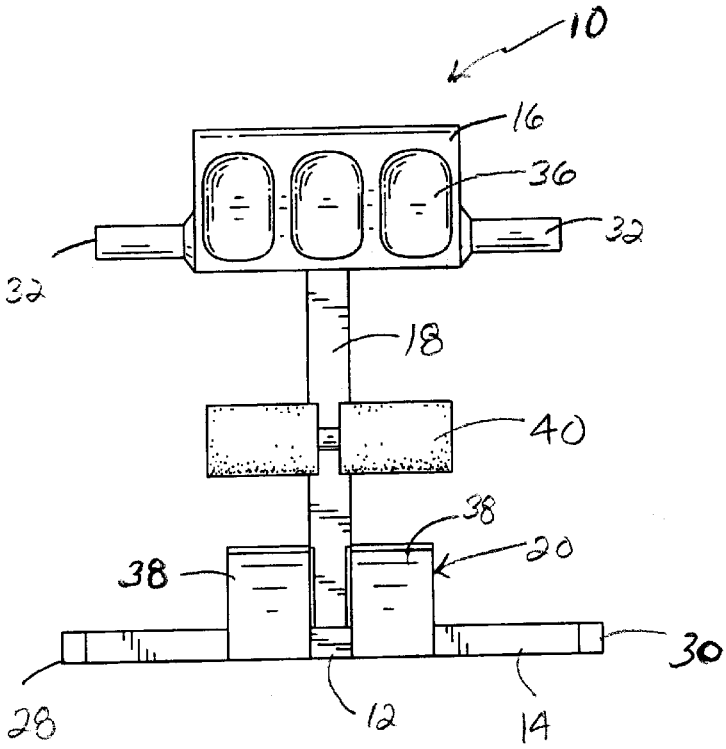
FIG. 4 is a rear elevational view of the back strengthening apparatus in accordance with the present invention.

Front and rear elevation views of back strengthening apparatus 10 are shown in FIGS. 3 and 4, respectively. Back strengthening apparatus 10 is preferably comprised of a sturdy lightweight metal which is capable of being machine cut and molded into the desired configuration of separate pieces previously described above. Roll bar 40 is preferably comprised of a sturdy foam or cushioning material that "gives" sightly when pressure is applied. Roll bar 40 may also be comprised of a lightweight metal with a foam sleeve surrounding it. Handle members 32 are preferably comprised of a lightweight metal having a rubber or foam type sleeve or outer coating to facilitate gripping.

Figure 5:
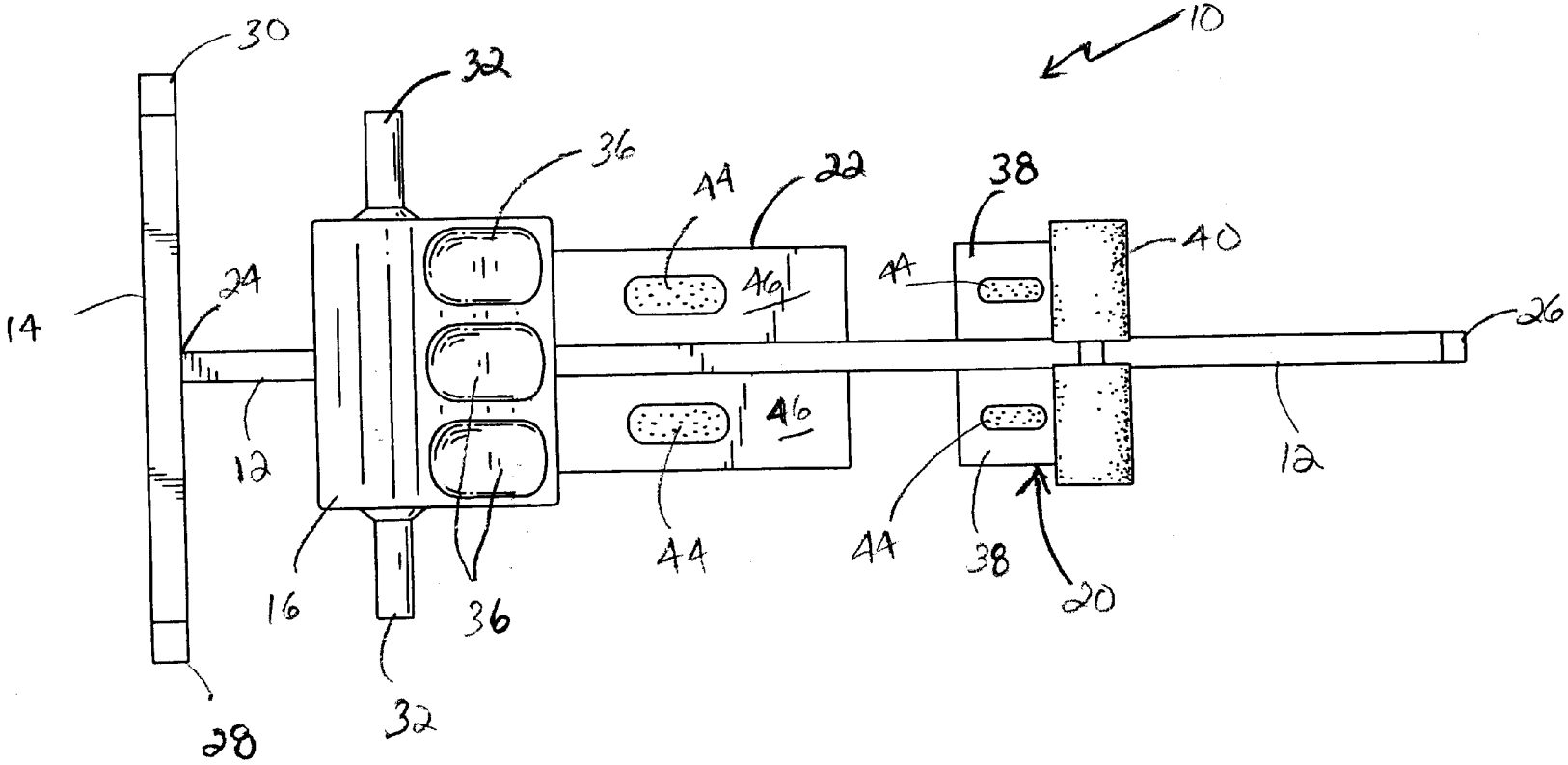
FIG. 5 is a top plan view of the back strengthening apparatus in accordance with the present invention.

FIG. 5 shows a top plan view of back strengthening apparatus 10 of the present invention. Support member 16 comprises at least one indentation 36, and preferably three indentations 36, to accommodate a user's pelvis and lower abdominal area. Support member 16, like the rest of back strengthening apparatus 10, is preferably comprised of a sturdy lightweight metal. Indentations 36 in the lightweight metal support member 16 enable a user to stabilize and appropriately position his body during back strengthening exercises using apparatus 10 thereby ensuring exercises such as back extensions are performed correctly without slipping and/or injuring the back. In a preferable embodiment, the middle indentation 36 is slightly larger than outer indentations 36 so that opposite sides of a user's pelvis can be positioned within outer indentations 36 and a user's lower abdominal area, which can sometimes be larger due to excess weight, can be positioned in middle indentation 36.

Side elevational views of the back strengthening apparatus of the present invention shown with the foot plate removed and an individual shown in phantom utilizing the apparatus to perform a back stretch exercise are shown in FIGS. 6–7. An optional seat plate 50 may be included and configured to be slidably attached to first horizontal base member 12 but the exercise shown can be easily performed without such a seat plate. The back stretch exercise is performed by straddling first horizontal base member 12, placing both feet on planar support plate 22, and grasping handle members 32 of support member 16 with both hands. A user then squats with their knees bent as shown in FIG. 7 and then extends their legs by pushing their lower body away from vertical support bar 18 to perform the exercise. The user then pulls his lower body back toward vertical support bar 18 so that his knees are fully bent and then again extends his legs to push his lower body away from vertical support bar 18. This process is then repeated to perform multiple sets of the exercise. If optional seat plate 50 is not included, the user's buttocks remains positioned slightly above first horizontal base member 12, and moves along the length of first horizontal base member 12, during the course of the exercise. If optional seat plate 12 is used, the user sits on seat plate 50 an slides seat plate 50 toward and away from vertical support bar 18 during the exercise.

Figure 9:
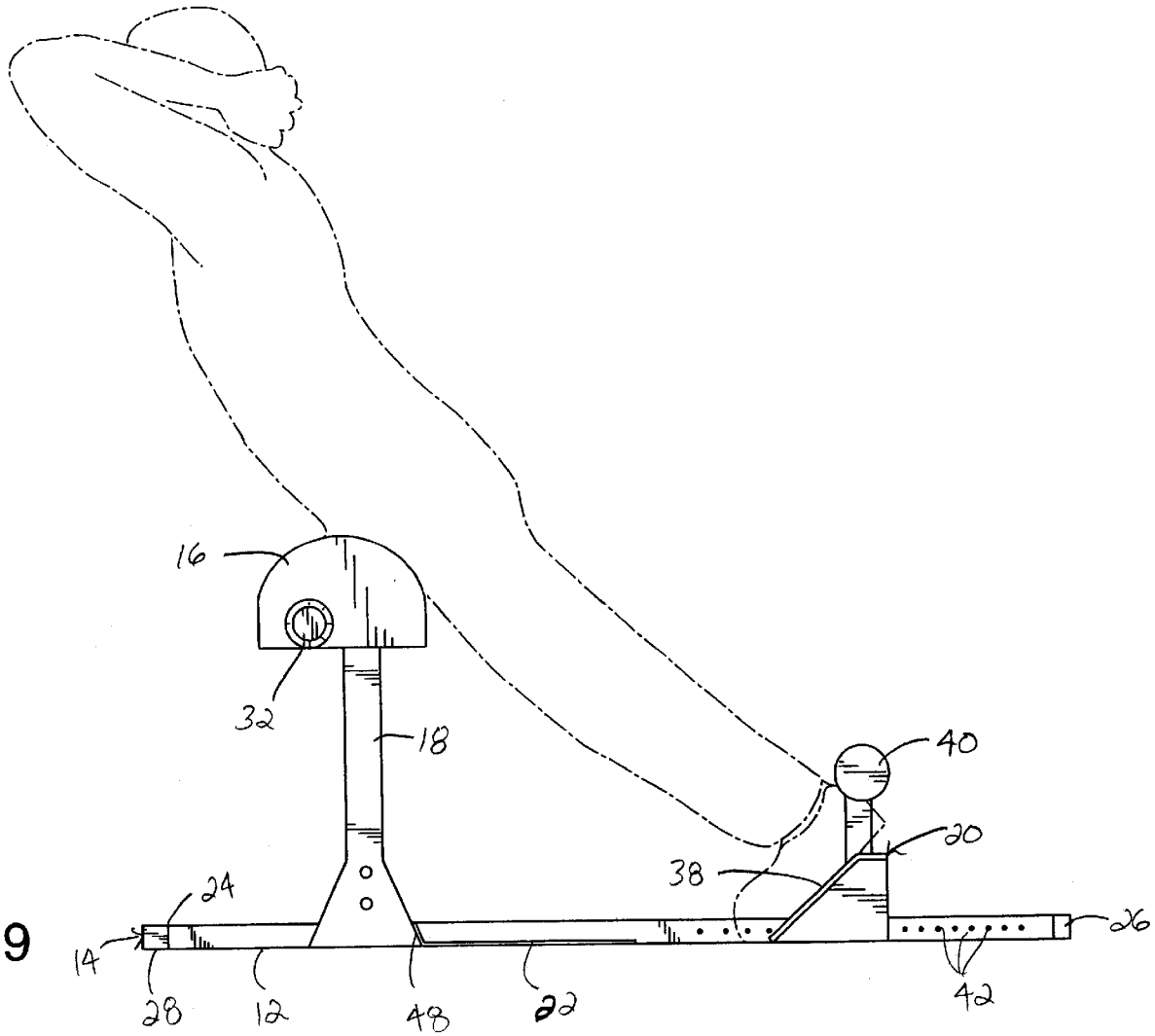

FIGS. 8–9 are side elevational views of the back strengthening apparatus of the present invention and an individual shown in phantom utilizing the apparatus to perform a back extension exercise. To perform this exercise, the user positions the removable and adjustable foot plate 20 along the length of first horizontal base member 12 so that a user's pelvis and lower abdominal area will lie adjacent to, and fit within, dentations 36 in support member 16 when the user's feet are positioned on planar plates 38 of foot plate 20. The user also tucks the heels of his feet under roll bar 40 and then bends over support member 16, with his hands behind his head, stretching his elbows toward the ground as shown in FIG. 8. To complete the exercise, the user lifts up his upper torso, with his hands still behind his head, until his head and feet are in one straight and continuous line with one another as shown in FIG. 9. The user's pelvis and lower abdominal area remains positioned within indentations 36 during the entire exercise. The exercise is then repeated multiple times. This exercise is also known in the physical fitness field as a reverse sit up.

Figure 10:
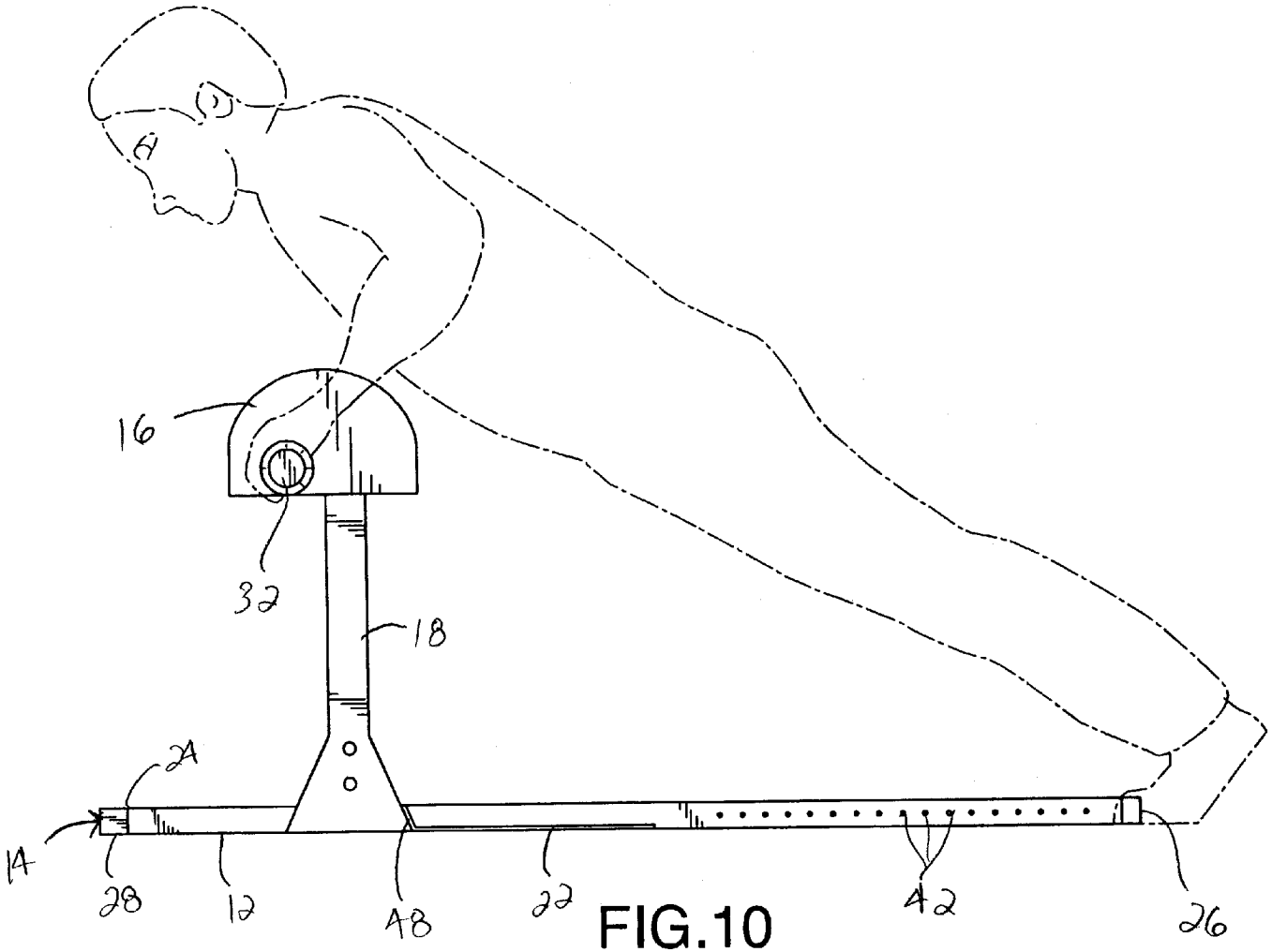
FIGS. 10–11 are side elevational view of the back strengthening apparatus of the present invention and an individual shown in phantom utilizing the apparatus to perform a braced push-up exercise.
Figure 11:
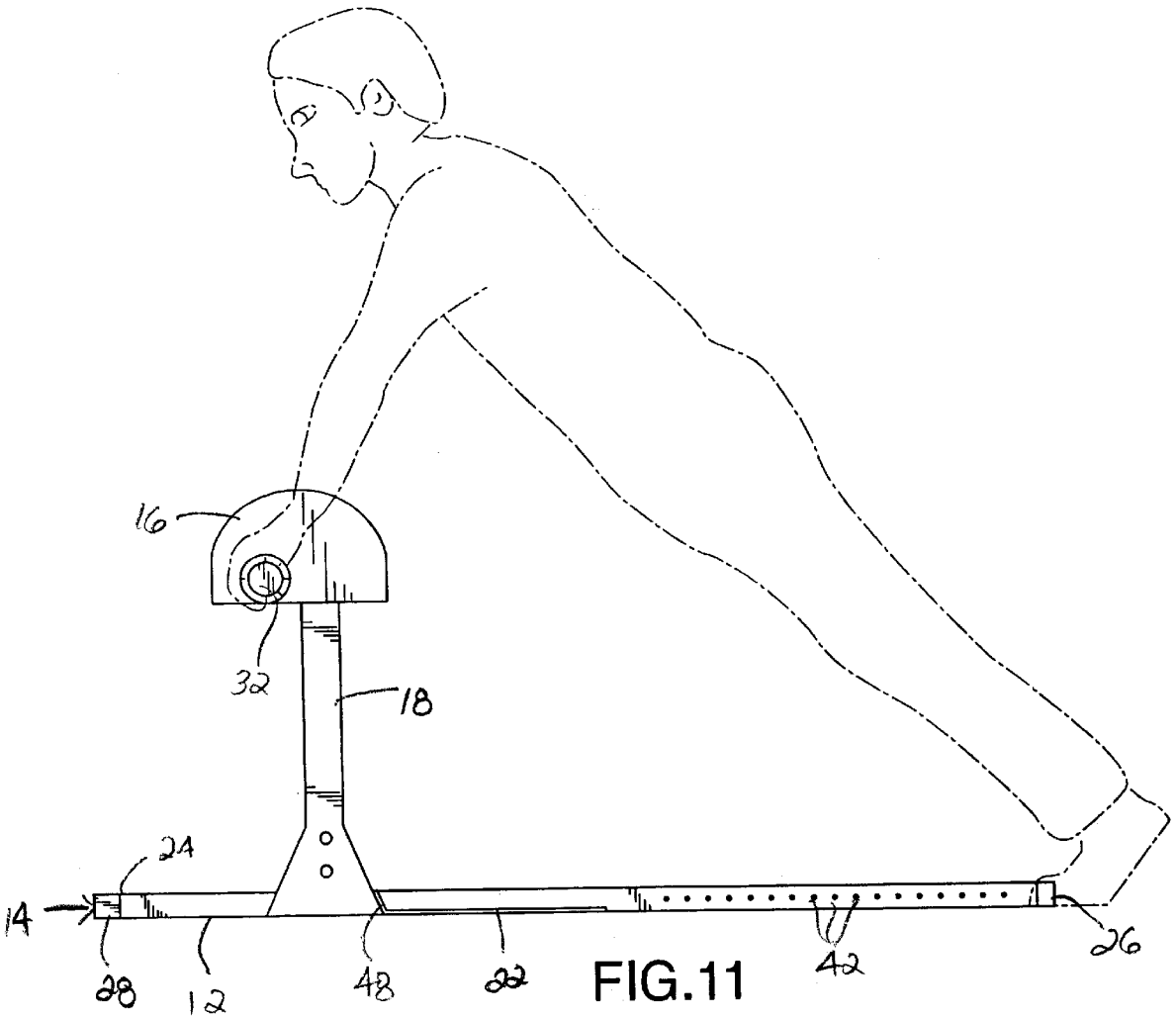

Side elevational views of the back strengthening apparatus of the present invention and an individual shown in phantom utilize the apparatus to perform a braced push-up exercise are shown in FIGS. 10–11. Foot plate 2 is disconnected and removed from first horizontal base member 12. To begin the exercise, a user straddles first horizontal base member 16 so that his feet are on opposite sides of first horizontal base member 16 and then grasps handle members 32 of support member 16 and bends is elbows to bring his chest area adjacent to support member 16 as shown in FIG. 10. To complete the braced push-up exercise, the user extends his arms and elbows by pushing away from support member 16 until his elbows are fully extended and his arms are straight as shown in FIG. 11. The user's legs and body remain on one straight and continuous line during the course of this exercise.

While the preferred embodiments of the invention have been shown and described, it will be apparent to those skilled in the that various changes and modifications may be made without departing from the true spirit and scope of the present invention. For that reason, the scope of the present invention is set forth in the following claims.

What is claimed is:

1. A back strengthening apparatus comprising:

a first horizontal base member having opposite ends;

a second horizontal base member having opposite ends attached perpendicularly to one end of said first horizontal base member at a point between said opposite ends of said second horizontal base member;

a support member for supporting a user's lower trunk area positioned above said first horizontal base member;

means for securing said support member in a vertical position above said first horizontal base member; and a planar support plate attached to a bottom of said first horizontal base member wherein at least a portion of said planar support member adjoins said securing means on a side of said securing means that is opposite said second horizontal base member.

2. The back strengthening apparatus of claim 1, further comprising a removable foot plate attached to said first horizontal base member near an end opposite said second horizontal base member.

3. The back strengthening apparatus of claim 2 wherein a position of said removable foot plate is adjustable along a length of said first horizontal base member.

4. The back strengthening apparatus of claim 1 wherein said support member comprises at least one indentation at a position where said user's lower trunk area is supported.

5. The back strengthening apparatus of claim 4 wherein said support member comprises at least two indentations substantially equal in shape and size positioned opposite one another to accommodate opposite hips of said user's lower trunk area.

6. The back strengthening apparatus of claim 5 wherein said support member comprises a third indentation located between said oppositely positioned indentations.

7. The back strengthening apparatus of claim 6 wherein said third indentation is larger in size than said oppositely positioned indentations.

8. A support member for supporting a user's lower front trunk area while performing back exercises, said support member comprising a semi-cylindrical shape having at least one indentation contained within an outer surface of a rounded portion of said semi-cylindrical shape.

9. The support member of claim 8 further comprising at least two indentations substantially equal in shape and size positioned opposite one another to accommodate opposite hips of the user's lower front trunk area.

10. The support member of claim 9 further comprising a third indentation located between said oppositely positioned indentations.

11. The support member of claim 10 wherein said third indentation is larger in size than said oppositely positioned indentations.

* * * * *